US008066591B2

(12) United States Patent
Zilverberg

(10) Patent No.: US 8,066,591 B2
(45) Date of Patent: Nov. 29, 2011

(54) PORTABLE RETRACTABLE SURFACE PROTECTION DEVICE

(76) Inventor: Larry Zilverberg, Medina, MN (US)

( * ) Notice: Subject to any disclaimer, the term of this patent is extended or adjusted under 35 U.S.C. 154(b) by 143 days.

(21) Appl. No.: 12/574,053

(22) Filed: Oct. 6, 2009

(65) Prior Publication Data

US 2010/0084100 A1 Apr. 8, 2010

Related U.S. Application Data

(60) Provisional application No. 61/103,664, filed on Oct. 8, 2008.

(51) Int. Cl.
*A63C 19/12* (2006.01)

(52) U.S. Cl. ..... 473/504; 242/919; 4/498; 160/238

(58) Field of Classification Search ..... 473/504; 242/919; 160/237, 238, 244, 241; 4/498
See application file for complete search history.

(56) References Cited

U.S. PATENT DOCUMENTS

| | | | | | |
|---|---|---|---|---|---|
| 987,635 | A * | 3/1911 | Mamaux | 473/504 |
| 1,052,498 | A * | 2/1913 | Reber | 473/504 |
| 1,250,011 | A * | 12/1917 | Mills | 242/391 |
| 1,606,658 | A * | 11/1926 | Mills | 473/504 |
| 2,581,083 | A * | 1/1952 | Drury | 160/241 |
| 3,108,804 | A * | 10/1963 | Wagner | 473/504 |
| 3,199,576 | A * | 8/1965 | Jericijo | 160/193 |
| 4,407,027 | A * | 10/1983 | Colon, Jr. | 242/395 |
| 4,632,329 | A * | 12/1986 | Burley | 473/504 |
| 4,749,325 | A * | 6/1988 | Hodgetts | 242/919 |
| 5,067,182 | A * | 11/1991 | Koelsch | 4/498 |
| 5,425,143 | A * | 6/1995 | Kalandovsky | 242/388.6 |
| 5,947,178 | A * | 9/1999 | Patten | 160/193 |
| 6,014,778 | A * | 1/2000 | Varnado | 4/502 |
| 2010/0072315 | A1 * | 3/2010 | Gordon et al. | 242/390.9 |
| 2010/0084100 | A1 * | 4/2010 | Zilverberg | 160/238 |

* cited by examiner

*Primary Examiner* — Mitra Aryanpour
(74) *Attorney, Agent, or Firm* — Merchant & Gould P.C.

(57) ABSTRACT

An example portable, retractable surface protection device. The example device includes a rotatable support bar, a first support base positioned to a first end of the support bar, a second support base positioned to a second end of the support bar, and a surface cover. A plurality of wheels are positioned to the second support base such that the device is wheelable. The device additionally includes a handle connected to the support bar for wrapping and unwrapping the surface cover onto the support bar. A plurality of removable weights positioned in the surface cover at least partially restrict movement of the surface cover when in a fully or a partially deployed position.

20 Claims, 10 Drawing Sheets

PORTABLE RETRACTABLE SURFACE PROTECTION DEVICE

RELATED APPLICATION

This application claims the benefit of U.S. patent application Ser. No. 61/103,664 filed on Oct. 8, 2008, the entirety of which is hereby incorporated by reference.

BACKGROUND

Recreational activities frequently include essential surfaces that are susceptible to damage from exposure to one or more surface damaging phenomena. For example, typical surface damaging mechanisms include physical contact resulting from participant interaction, exposure to inclement environmental conditions, and others. In this regard, maintenance and protection is required to safeguard a participant from injury and increase the lifetime of the surfaces.

DESCRIPTION OF THE DRAWINGS

Aspects of the disclosure may be more completely understood in consideration of the following detailed description of various embodiments of the disclosure in connection with the accompanying drawings, wherein.

DETAILED DESCRIPTION

The example embodiments described in the following disclosure are provided by way of illustration only and should not be construed as limiting. Various modifications and changes may be made to the example embodiments described below without departing from the true spirit and scope of the disclosure.

The present disclosure relates generally to a device for the protection of one or more surfaces used, for example, in a recreational activity, such as a pastime or a game. More specifically, the present disclosure relates to a portable, retractable surface protection device to protect one or more surfaces of a baseball field, such as a home plate and a pitching mound.

Although the following embodiments are directed towards the game of baseball, the device and methods of the present disclosure are applicable to any situation where it is desirable to provide protection of one or more surfaces from a wide variety of surface degrading phenomena.

Figure 1:
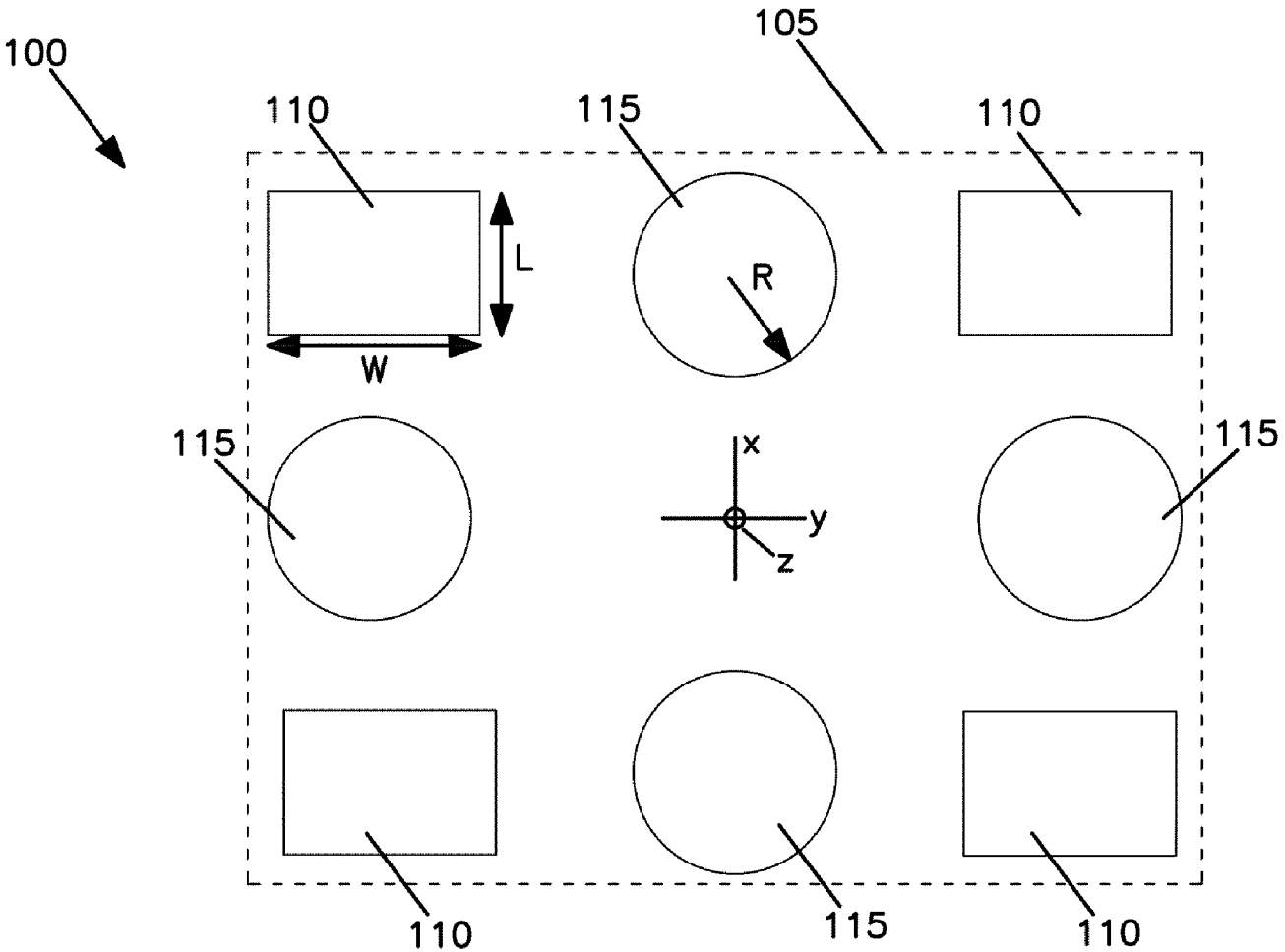
FIG. 1 is a top view of an example activity area having a plurality of surfaces.

Referring now to FIG. 1, a top view of an example activity area 100 is shown. In general, activity area 100 includes a plurality of surfaces utilized for a game, an activity, or the like. In the example embodiment, the activity area 100 includes a square boundary 105 defining a perimeter that encloses a plurality of first surfaces 110 and a plurality second surfaces 115. Other geometries of the boundary 105 are possible. Other positional configurations of surfaces 110, 115 within the boundary 105 are possible as well.

In one aspect, first surfaces 110 are rectangular in shape and have a surface area defined by a length L and a width W. Further, as depicted, second surfaces 115 are circular in shape and have a surface area defined by a radius R. In general, one or more of a plurality of surfaces having various shapes, geometries, and associated surface areas can be defined within the boundary 105 with respect to an orthogonal x-y-z coordinate axis.

Figure 2:
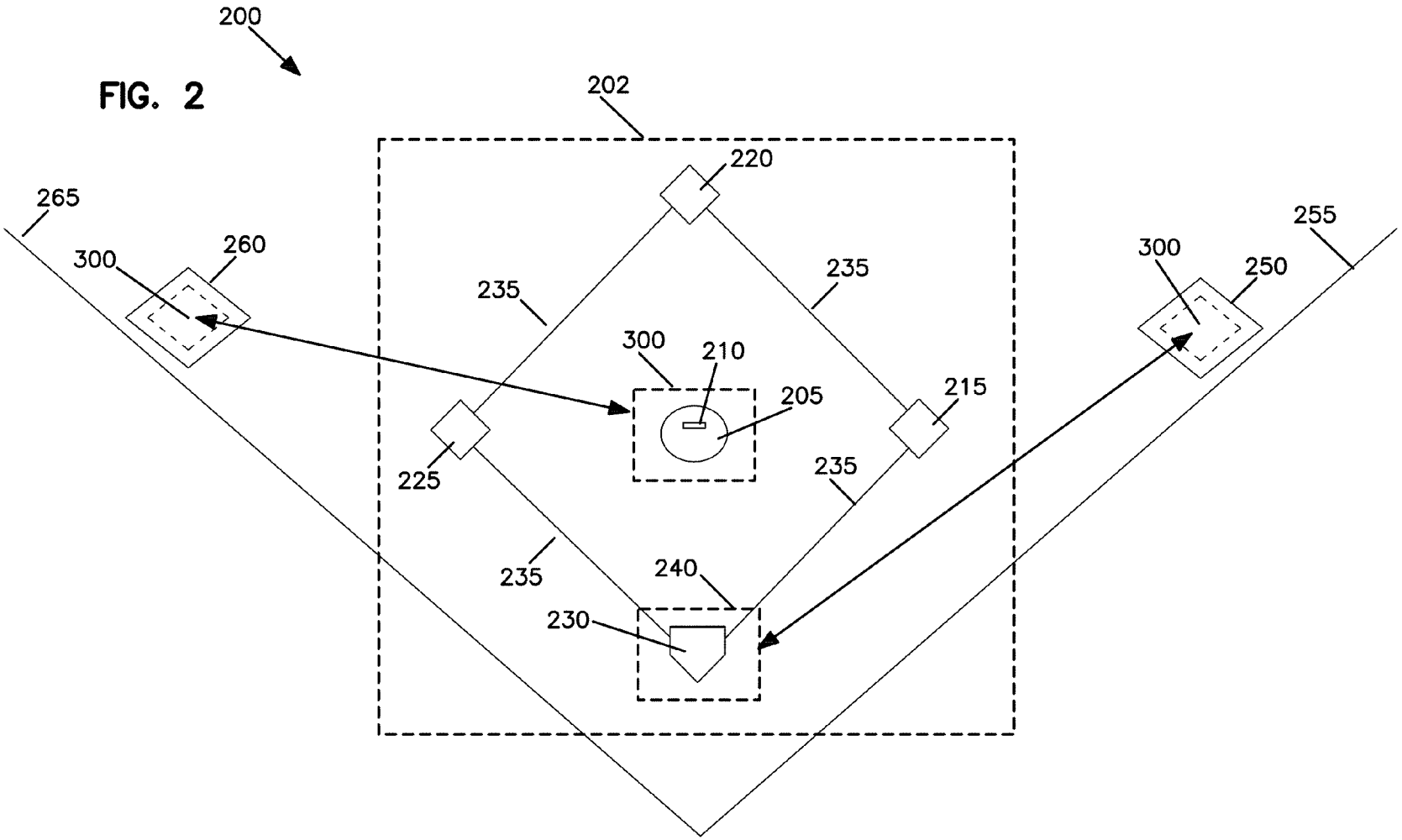
FIG. 2 is an infield portion of a baseball field.
Figure 3:
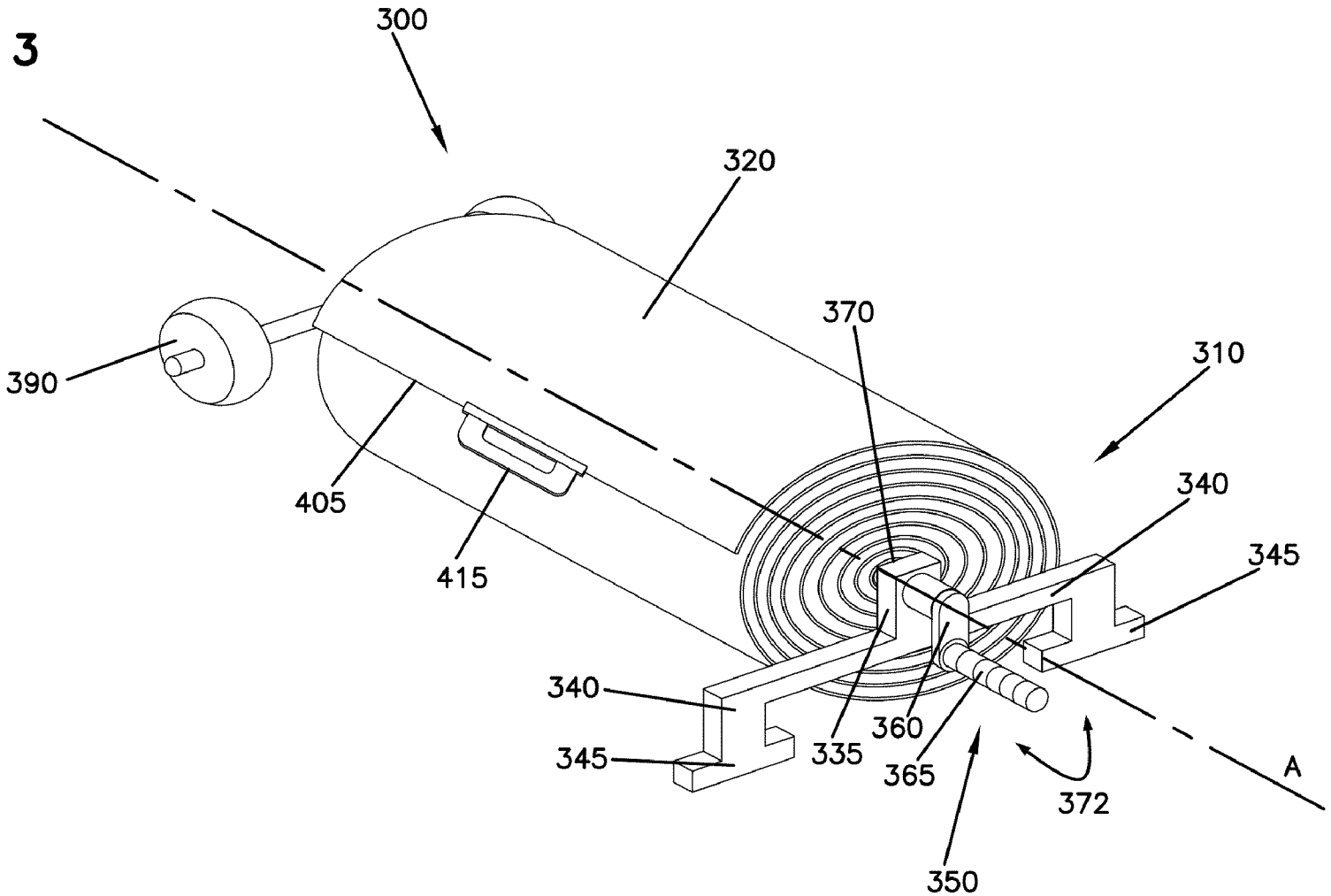
FIG. 3 is a perspective view of an example surface protection device.
Figure 4:
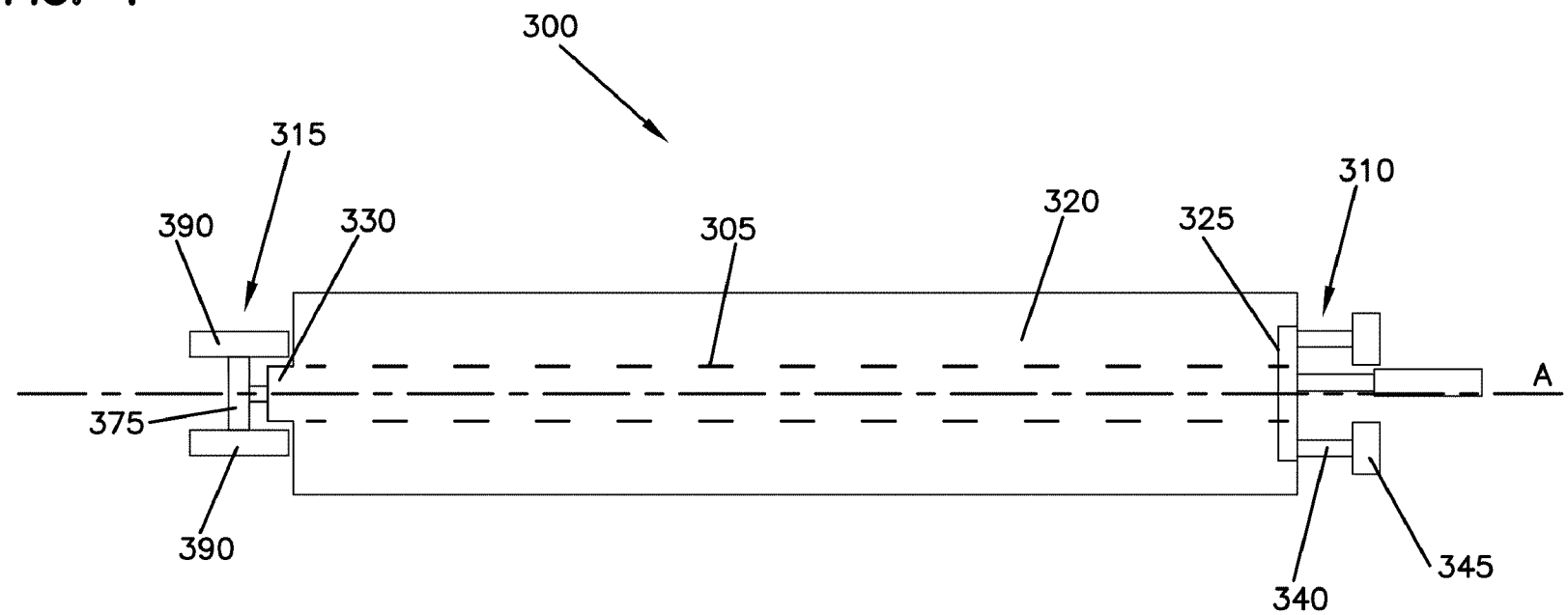
FIG. 4 is a top view of the surface protection device of FIG. 3.
Figure 5:
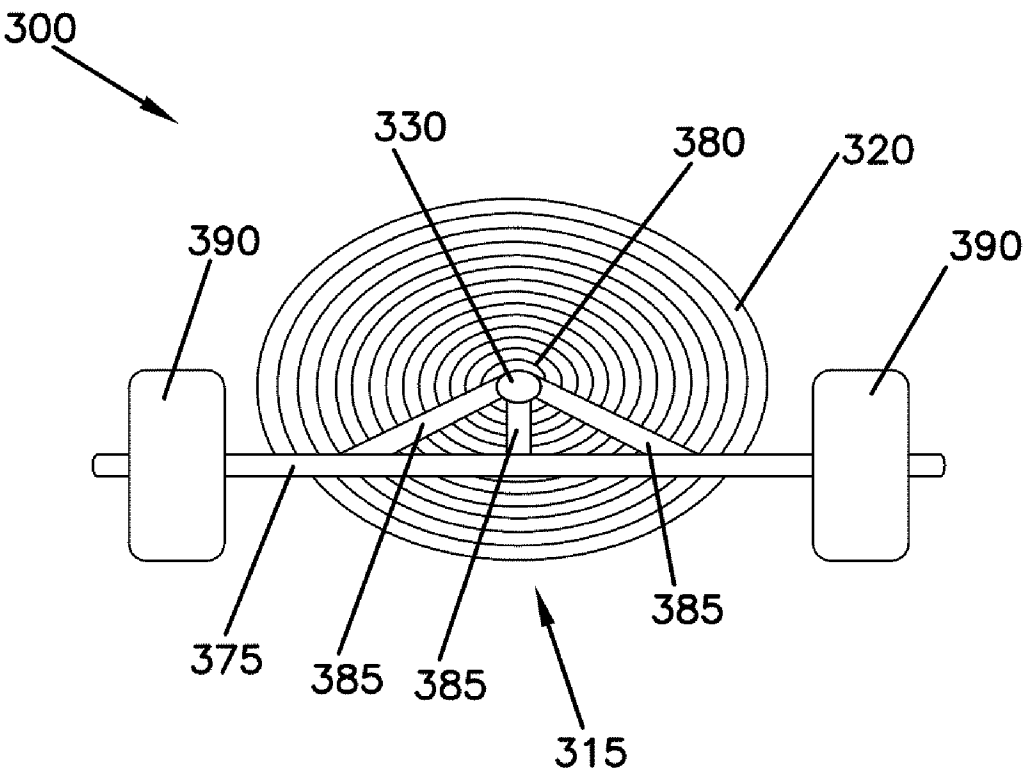
FIG. 5 is a first end view of the surface protection device of FIG. 3.
Figure 6:
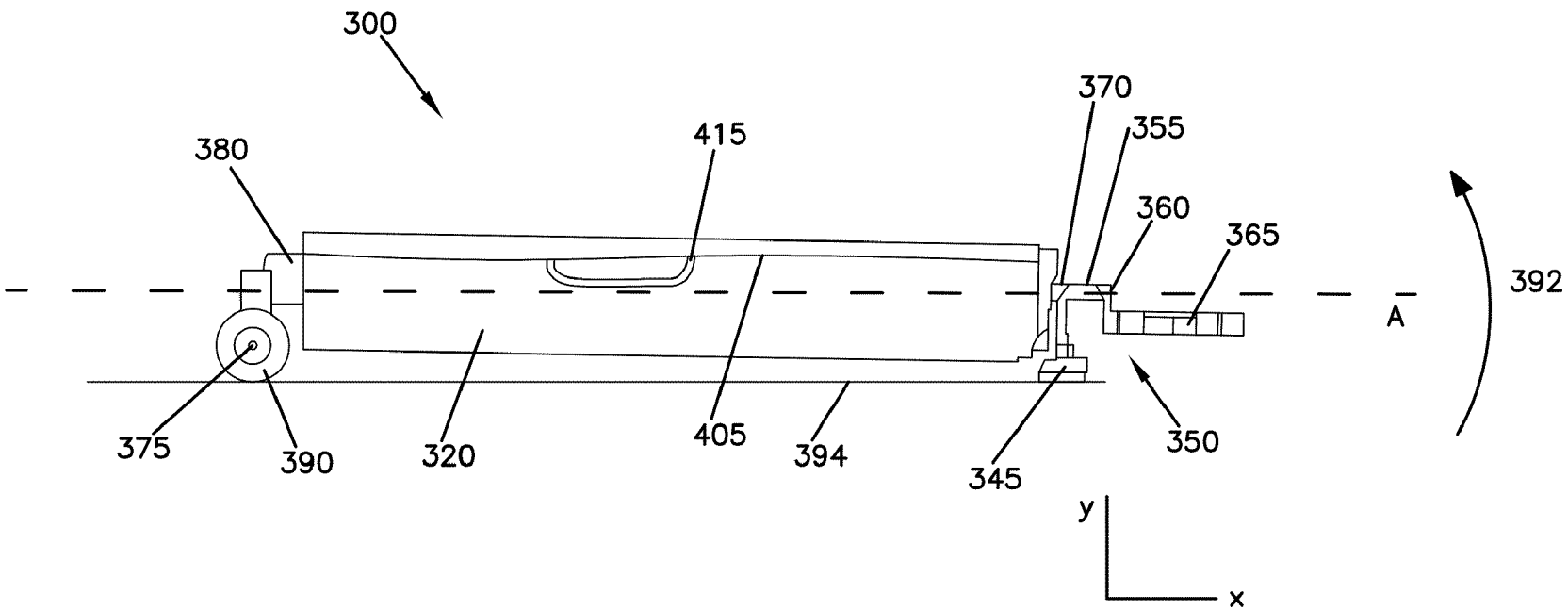
FIG. 6 is a side view of the surface protection device of FIG. 3.

Referring now to FIG. 2, a boundary 202 enclosing an infield portion of a baseball field 200 is shown. It will be appreciated that the boundary 202 is of an arbitrary size and can be chosen to encompass any portion of the baseball field 200 as desired. The baseball field 200 is an example of an activity area 100 as described above with respect to FIG. 1.

Enclosed within a perimeter defined by the boundary 202 is a pitching mound 205 including a pitching rubber 210, a first base 215, a second base 220, a third base 225, and a home plate area 230. A base path 235 is additionally shown. In general, pitching mound 205 and respective areas 215, 220, 225, and 230 are susceptible to damage from one or more surface degrading phenomena such as; intentional physical contact, unintentional physical contact, or environmental conditions, among others.

In the example embodiment, the physical integrity of the pitching mound 205 and respective areas 215, 220, 225, 230 is critical to the quality of the game, well-being of the game players, respective surface longevity, and other factors as well. In this regard, protection of one or more of the described areas 205, 215, 220, 225, and 230 from a plurality of conditions is desirable.

For example, in one aspect it may be desirable to protect the pitching mound 205 or any other respective surfaces 215, 220, 225, 230 from rain or other inclement weather with a surface protection device 300 such that damage (e.g., erosion, water saturation, etc.) does not occur. In a second example, it may be desirable to protect home plate 230, plus an additional supplemental area (e.g., a batter's box), with a similar surface protection device 300 between innings of a baseball to protect home plate and the supplemental area from unwanted abuse. Other uses are possible.

In certain embodiments, the surface protection device 300 can be stored and retrieved for deployment from a designated area of the baseball field 200. For example, one surface protection device 300 can be stored at a first area 250 along a first boundary 255 of the baseball field 200. Similarly, another surface protection device 300 can be stored at a second area 260 along a second boundary 265 of the baseball field 200. In this manner, the first and second surface protection devices 300 can easily be retrieved from respective areas 250, 260 when required. Other configurations are possible.

Figure 7:
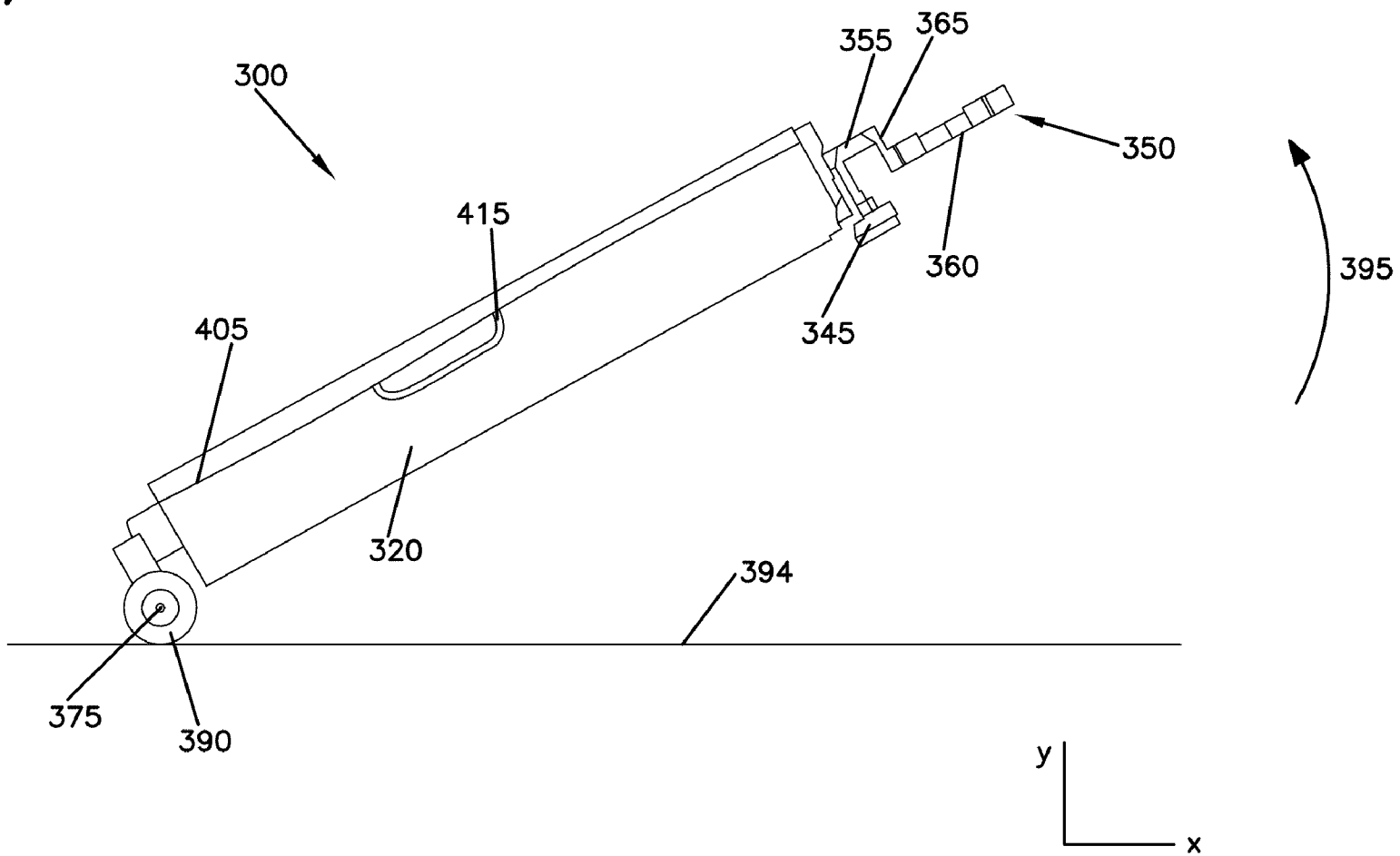
FIG. 7 is the surface protection device of FIG. 6 at an angled position.
Figure 8:
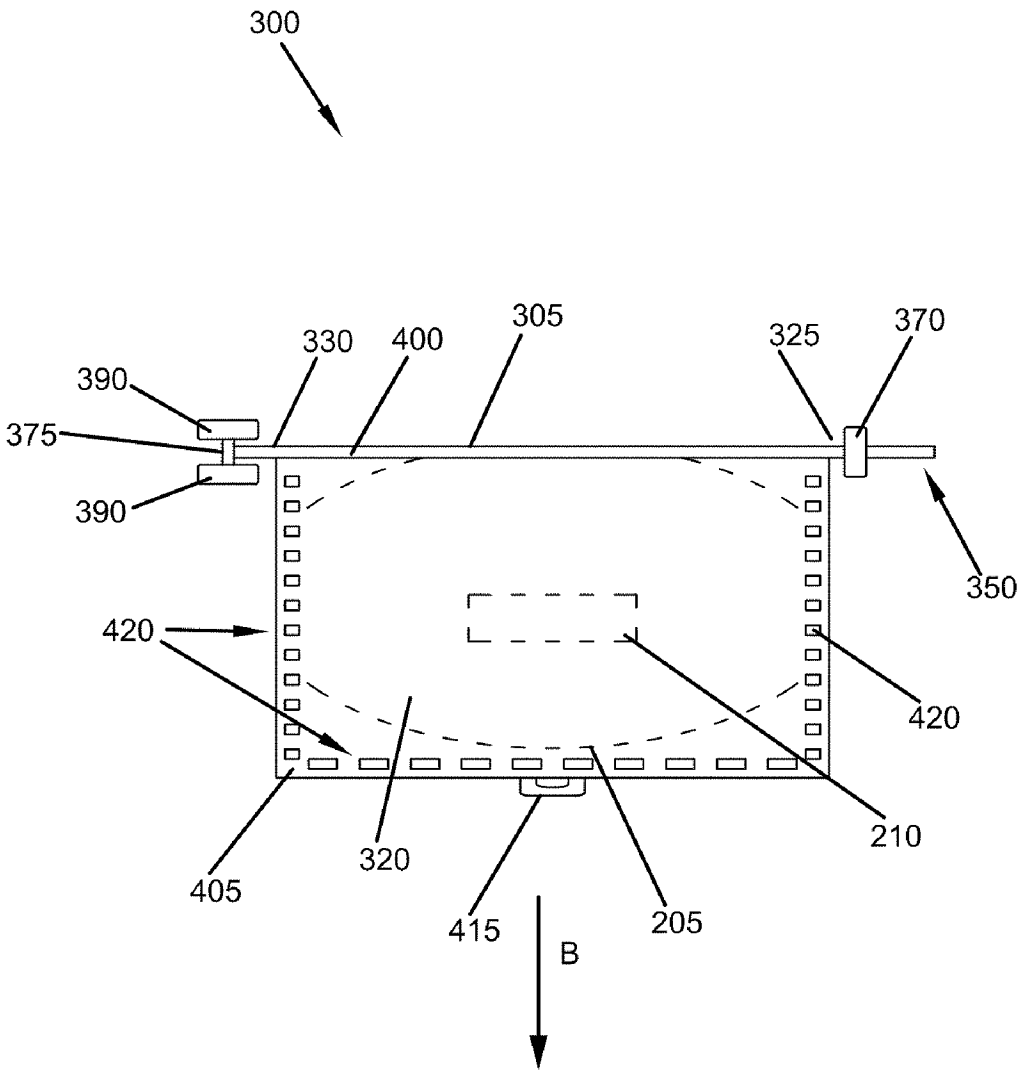
FIG. 8 is a top view of the surface protection device of FIG. 3, depicting an extended surface covering protecting a pitching mound.
Figure 9:
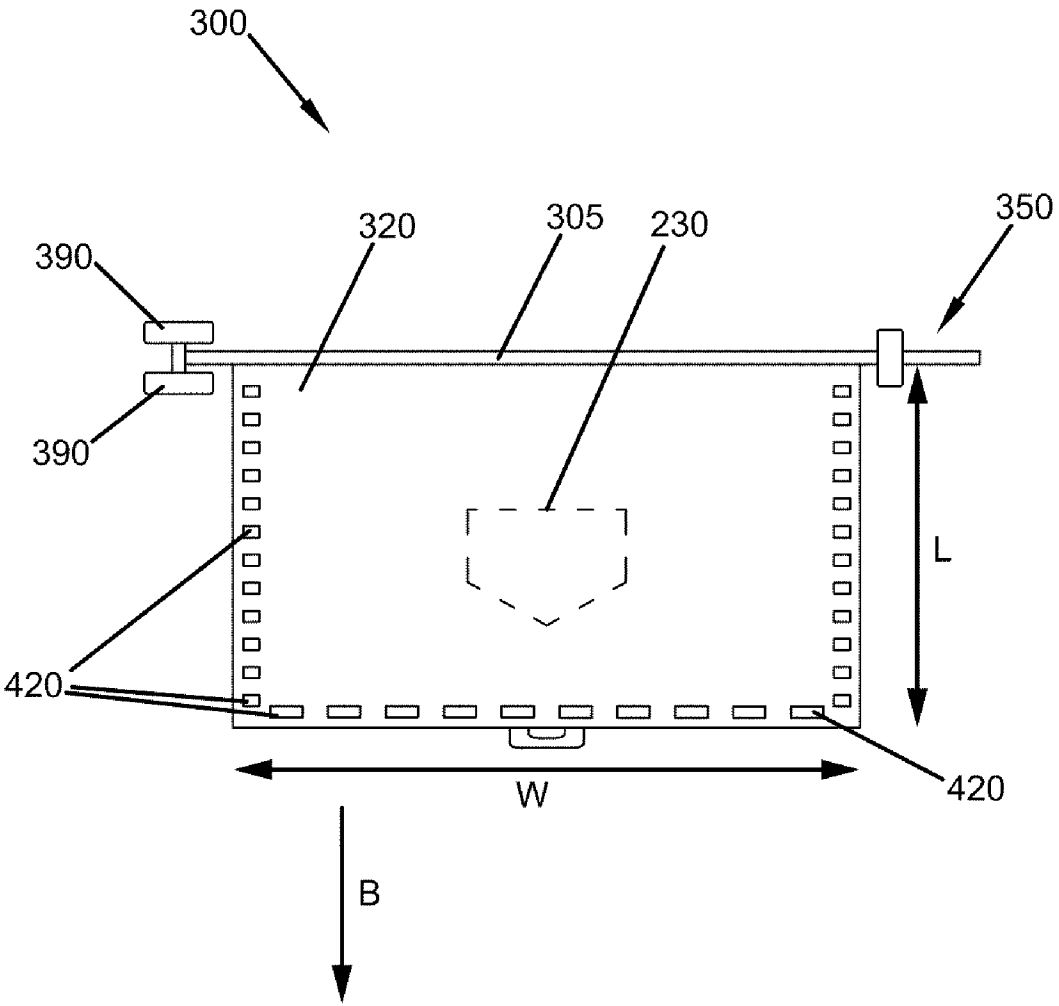
FIG. 9 is a top view of the surface protection device of FIG. 3, depicting an extended surface covering protecting a home plate.

Referring now to FIGS. 3-9, the example surface protection device 300 is shown in greater detail. In general, surface protection device 300 is portable and includes a frame portion that supports a protective surface covering that is retractably deployable between a retracted position, as shown in FIGS. 3-6, and a deployed position, as shown in FIG. 7 and FIG. 8. It will be appreciated that the protective surface covering described herein may by fully deployed such that an entire length of the covering is exposed, or partially deployed such that only a section of the covering is exposed. Further, a surface covering according to one embodiment of the present disclosure can be used for covering and protecting the pitching mound 205, home plate 230/240, and/or other respective surfaces 215, 220, 225 as described with reference to FIG. 2.

In one embodiment, the surface protection device 300 includes a support bar 305 having a first end 325 and a second end 330, a first support base 310, a second support base 315, and a grip handle 350. In one embodiment, support bar 305 is a cylindrical bar. In general, elements 305, 310, 315 and 350 are dually provided to enable actuation of a surface covering 320 to cover a surface, and to facilitate the movement of the surface protection device 300 to a desired location, such as for example, within activity area 100 as shown in FIG. 1.

In general, first support base 310 is a U-shaped bracket member and is positioned to the first end 325 of support bar 305. First support base 310 includes a main support member 335 and a plurality of secondary support members 340 integrally formed with and extending from the main support member 335 to form the U-shape. In one embodiment, each of the plurality of secondary support members 340 are terminated with a stabilizer footing 345 such that, for example, the surface protection device 300 rests stably on a ground surface 394.

In one embodiment, grip handle 350 is "step-shaped" and includes a connector portion 355, a lever portion 360, and a handle portion 365. The connector portion 355 of the grip handle 350 is positioned through a first receiving aperture 370 formed on the main support member 335 and is connected to the first end 325 of the support bar 305. In one embodiment, connector portion 355 is aligned with a longitudinal axis, A. Axis A is additionally coincident with a primary longitudinal axis (not shown) of the support bar 305.

The second support base 315 is generally positioned to the second end 330 of the support bar 305. In one embodiment, second support base 315 includes an axle 375, a second receiving aperture 380. A plurality of support members 385 are positioned between the axle 375 and the second receiving aperture 380. Second end 330 of support bar 305 is positioned through second receiving aperture 380.

The second support base 315 additionally includes a plurality of wheels 390 positioned on the axle 375. In general, wheels 390 enable the surface protection device 300 to be easily transported to a desired location such as within boundary 202 as shown in FIG. 2. In one embodiment, first support base 310 is moved in a direction 395 from a horizontal position, as shown FIG. 6, to an angled position as shown in FIG. 7, with respect to orthogonal axis x-y. In this manner, surface protection device 300 can be wheeled to a desired location. In general, support members 385 evenly distribute the force of the load presented by the surface protection device 300 to the wheels 390 during movement of the surface protection device 300.

In the example embodiment, surface covering 320 has a length L and a width, W and includes a fixed end 400 connected to the support bar 305 and a free end 405 opposite of the fixed end 400. In this manner, surface covering 320 is wrapped onto the support bar 305. In certain embodiments, the length L is much greater than the width W, and the surface covering 320 can be positioned from the retracted position to a partially or a fully deployed position. The length L and width W can be modified based on intended uses. For example, the length L and/or width W can be increased or decreased to cover more or less surface area depending on the size of the area to be covered.

Surface covering 320 includes a hand grip 415 positioned on the free end 405. In certain embodiments, hand grip 415 can be utilized to unroll the surface covering 320 as desired from the retracted position to a deployed position by pulling the hand grip 415 in a direction B. Further, hand grip 415 enables a user to manipulate and position the surface covering 320 on a ground surface 394 when in the fully or partially deployed position.

In other example embodiments, surface covering 320 can be extended from the retracted position to a partially or a fully deployed position, or unwrapped, via handle portion 365 rotation in either a counterclockwise or a clockwise direction, depending on a direction the surface covering 320 is wrapped on the support bar 305. To remove the surface covering 320, the handle portion 365 can be rotated in the opposite direction to wrap the surface covering 320 back onto the support bar 305.

In some embodiments, rotation of the support bar 305 can be limited before or after deployment of the surface covering 320. For example, once the surface covering 320 is completely rolled onto the support bar 305, a locking mechanism (not shown) can be actuated to stop the support bar 305 from rotating in the opposite direction to minimize the possibility of accidental deployment of the surface covering 320 during transport. In addition, the free end 405 of the surface cover 320 can be coupled to another locking mechanism (not shown) to stop the free end 405 from dragging or catching on other items during transport. Other configurations are possible.

In certain embodiments, a plurality of removable weights 420 is incorporated into surface covering 320. In one embodiment, weights 420 are incorporated into an outer edge of the surface covering 320. It will be appreciated that the respective weights 420 provide a stabilizing mechanism for surface covering 320 in the deployed or partially deployed positions by at least partially restricting movement of surface covering 320. For example, the weights 420 can stabilize the covering 320 so that the covering 320 is not displaced by environmental conditions such as wind.

In general, surface covering 320 is formed from a durable, water resistant material. In one example embodiment, surface covering 320 is formed from a tarpaulin material such as latex or a polyvinyl chloride. Other types of materials, such as polymeric or fabric materials that limit the passage of water and other debris therethrough, can also be used.

Figure 10:
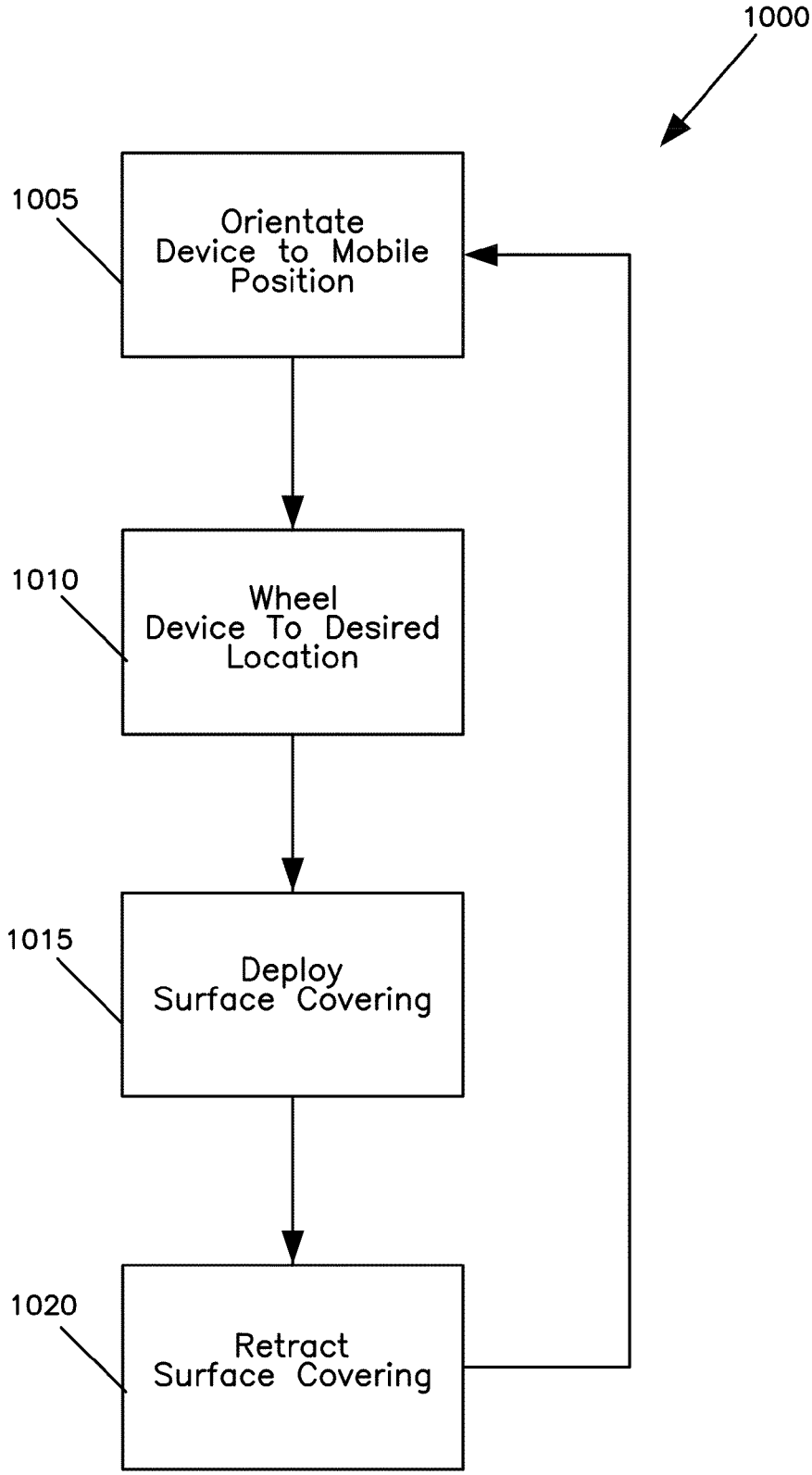
FIG. 10 is an example method of use of a surface protection device.

Referring now to FIG. 10, an example method 1000 is shown for using surface protection device 300 according to the principals of the present disclosure.

Initially, at operation 1005, surface protection device is orientated to an angled, mobile position from a horizontal position. In the horizontal position, both the respective wheels and the stabilizer footings are in contact with the ground surface. Once orientated to the mobile position only the respective wheels are in contact with the ground surface.

Next, at operation 1010, surface protection device is wheeled to a desired location within a recreational area. Surface protection device is for example moved to the vicinity of a pitching mound or a home plate.

Next, at operation 1015, support surface covering is unwrapped from a retracted position to a fully or a partially deployed position such that at least an entire area of a desired surface is covered. In certain embodiments, support surface covering can be deployed and situated accordingly via manipulation with the handle grip positioned on the free end. Alternatively, grip handle can be utilized to unwrap a desired portion of the support surface covering.

Next, at operation 1020, support surface covering is retracted from the deployed position to a retracted position by rotating the grip handle in a first direction to wrap the support surface covering onto the support bar and is secured.

Flow proceeds back to operation 1005 wherein the surface protection device is moved from the horizontal position to the mobile position and wheeled to a desired location such as a storage area.

The preceding embodiments are intended to illustrate without limitation the utility and scope of the present disclosure. Those skilled in the art will readily recognize various modifications and changes that may be made to the embodiments described above without departing from the true spirit and scope of the disclosure.

What is claimed is:

1. A portable, retractable surface protection device, comprising:

a rotatable support bar;

a first support base coupled to a first end of the support bar;

a second support base coupled to a second end of the support bar, wherein the second support base includes a plurality of wheels;

a handle coupled to the support bar and the first support base; and a surface cover including first and second free sides, a fixed end connected to the support bar, a hand grip positioned on an opposite free end, and at least a first plurality of removable weights coupled to the free end of the cover; wherein the cover is positioned to a deployed position from a retracted position by actuating the handle in a first direction and positioned to the retracted positioned from the deployed position by actuating the handle in a direction opposite of the first direction.

2. The surface protection device of claim 1, wherein the rotatable support bar is a cylindrical bar.

3. The surface protection device of claim 1, wherein the first support base is a U-shaped bracket including a main support and a plurality of secondary supports integrally formed with and extending from the main support.

4. The surface protection device of claim 3, wherein each of the plurality of secondary supports is terminated with a footing that stabilizes the surface protection device on a ground surface.

5. The surface protection device of claim 1, wherein the handle is step-shaped and includes a connector portion, a lever portion, and a handle portion.

6. The surface protection device of claim 5, wherein the connector portion is positioned through a first receiving aperture formed on the main support and is connected to the first end of the support bar.

7. The surface protection device of claim 6, wherein the plurality of wheels are positioned on an axle of the second support base, and wherein the second support base further includes a second receiving aperture and a plurality of support members positioned between the axle and the second receiving aperture.

8. The surface protection device of claim 7, wherein the plurality of support members distributes force of a load presented by the surface protection device to the plurality of wheels.

9. The surface protection device of claim 7, wherein the second end of the support bar is positioned through the second receiving aperture.

10. The surface protection device of claim 1, wherein a second plurality of removable weights coupled to the first and second free sides of the cover.

11. The surface protection device of claim 1, wherein the surface cover is formed from a material selected from the group consisting of: a latex material; a polyvinyl chloride material; a polymeric material; and a fabric material.

12. The surface protection device of claim 1, wherein the surface cover is sized to at least partially cover one or more features of a baseball field including a pitching mound, a base plate, and a batters box.

13. A portable and retractable surface protection device for protecting features of a baseball field, comprising:

a rotatable cylindrical support bar;

a first support base coupled to a first end of the support bar, wherein the first support base is a U-shaped bracket including a main support and a plurality of secondary supports integrally formed with and extending from the main support;

a second support base coupled to a second end of the support bar, wherein the second support base includes a plurality of wheels;

a handle coupled to the support bar and the first support base; and a surface cover including first and second free sides, a fixed end connected to the support bar, a hand grip positioned on an opposite free end, a first plurality of removable weights coupled to the free end of the cover, and a second plurality of removable weights coupled to first and second free sides of the cover;

wherein the cover is positioned to a deployed position from a retracted position by actuating the handle in a first direction and positioned to the retracted positioned from the deployed position by actuating the handle in a direction opposite of the first direction.

14. The surface protection device of claim 13, wherein the surface cover is formed from a material selected from the group consisting of: a latex material; a polyvinyl chloride material; a polymeric material; and a fabric material.

15. The surface protection device of claim 13, wherein each of the plurality of secondary supports is terminated with a footing that stabilizes the surface protection device on a ground surface.

16. The surface protection device of claim 13, wherein the handle is step-shaped and includes a connector portion, a lever portion, and a handle portion.

17. The surface protection device of claim 16, wherein the connector portion is positioned through a first receiving aperture formed on the main support and is connected to the first end of the support bar.

18. The surface protection device of claim 17, wherein the plurality of wheels is positioned to an axle of the second support base, and wherein the second support base further includes a second receiving aperture and a plurality of support members positioned between the axle and the second receiving aperture.

19. The surface protection device of claim 18, wherein the second end of the support bar is positioned through the second receiving aperture.

20. A surface protection device for protecting features of a baseball field, comprising:

a rotatable cylindrical support bar;

a first support base coupled to a first end of the support bar, wherein the first support base is a U-shaped bracket including a main support and a plurality of secondary supports integrally formed with and extending from the main support, and wherein each of the plurality of secondary supports is terminated with a footing that stabilizes the surface protection device on a ground surface;

a second support base coupled to a second end of the support bar, wherein the second support base includes a plurality of wheels positioned to an axle of the second support base, and wherein the second support base further includes a second receiving aperture and a plurality of support members positioned between the axle and the second receiving aperture, wherein the second end of the support bar is positioned through second receiving aperture and the plurality of support members distributes force of a load presented by the surface protection device to the plurality of wheels;

a step-shaped handle coupled to the support bar and the first support base, wherein the step-shaped handle includes a connector portion, a lever portion, and a handle portion, and wherein the connector portion is positioned through a first receiving aperture formed on the main support and is connected to the first end of the support bar; and a surface cover including first and second free sides, a fixed end connected to the support bar, a hand grip positioned on an opposite free end, a plurality of removable weights coupled to the free end of the cover, and a second plurality of removable weights coupled to the first and second free sides of the cover, wherein the surface cover is sized to at least partially cover one or more features of the baseball field and is formed from a material selected from the group consisting of: a latex material; a polyvinyl chloride material; a polymeric material; and a fabric material;

wherein the cover is positioned to a deployed position from a retracted position by actuating the handle in a first direction and positioned to the retracted positioned from the deployed position by actuating the handle in a direction opposite of the first direction.

* * * * *

UNITED STATES PATENT AND TRADEMARK OFFICE

CERTIFICATE OF CORRECTION

PATENT NO. : 8,066,591 B2
APPLICATION NO. : 12/574053
DATED : November 29, 2011
INVENTOR(S) : Zilverberg It is certified that error appears in the above-identified patent and that said Letters Patent is hereby corrected as shown below:

Col. 5, line 66, claim 10: "removable weights coupled to the" should read --removable weights are coupled to the--

Col. 6, line 31, claim 13: "retracted positioned from" should read --retracted position from--

Col. 8, line 14, claim 20: "retracted positioned from" should read --retracted position from--

Signed and Sealed this
Seventh Day of August, 2012

David J. Kappos

David J. Kappos
*Director of the United States Patent and Trademark Office*